United States Patent [19]

Hale

[11] 4,358,193

[45] Nov. 9, 1982

[54] DIAZO DEVELOPMENT APPARATUS

[75] Inventor: Joseph F. Hale, Ashford, England

[73] Assignee: GAF Corporation, New York, N.Y.

[21] Appl. No.: 195,546

[22] Filed: Oct. 9, 1980

[30] Foreign Application Priority Data

Nov. 9, 1979 [GB] United Kingdom ..... 7938936

[51] Int. Cl.[3] ..... G03D 7/00

[52] U.S. Cl. ..... 354/299; 354/300; 34/51; 355/27

[58] Field of Search ..... 354/299, 300, 324; 355/27, 100, 106; 34/4, 41, 48, 51

[56] References Cited

U.S. PATENT DOCUMENTS

| | | | |
|---|---|---|---|
| 3,900,862 | 8/1975 | Bennett | 354/300 |
| 3,943,538 | 3/1976 | Hilgers et al. | 354/299 |
| 4,048,645 | 9/1977 | Reams | 354/300 |
| 4,092,658 | 5/1978 | Schroter | 354/300 |
| 4,109,268 | 8/1978 | Schroter et al. | 354/299 |
| 4,135,814 | 1/1979 | Schroter et al. | 355/106 |
| 4,182,567 | 1/1980 | Laar et al. | 354/299 |
| 4,255,037 | 3/1981 | Meadows et al. | 354/299 |

*Primary Examiner*—L. T. Hix
*Assistant Examiner*—Alan Mathews
*Attorney, Agent, or Firm*—Kane, Dalsimer, Kane, Sullivan and Kurucz

[57] ABSTRACT

The present invention relates to diazo copiers and is concerned with the supply of gaseous developing agent to a developing section of a copier, and the removal of surplus developing agent from this section of the copier, and from the developed copy material. The copier apparatus includes means to pass the developing agent (a gas) from a reservoir and through a gas governor. The governor functions to reduce the gas pressure to a set, lower value. The lower pressure gas then enters a development chamber through which the material for development also passes. Surplus gas is removed from the material for development by a heating and suction means.

2 Claims, 6 Drawing Figures

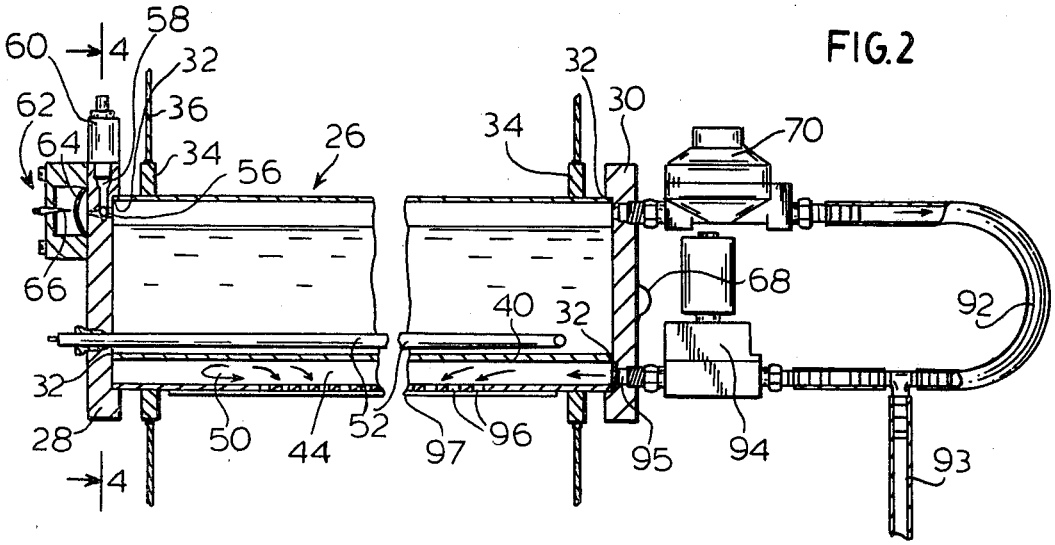
FIG. 2
FIG. 5
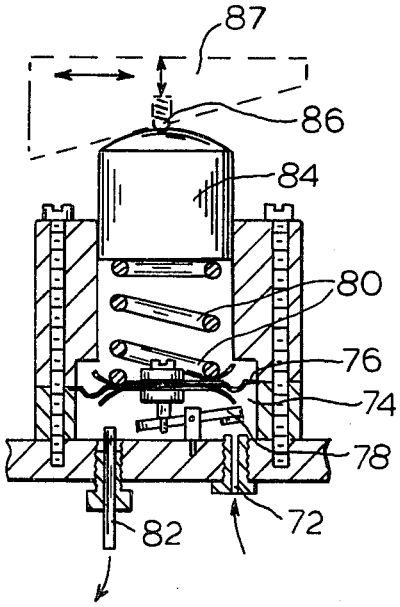

DIAZO DEVELOPMENT APPARATUS

BACKGROUND OF THE INVENTION

Many conventional copiers generate ammonia vapor from an aqueous ammonia solution with a heater. The current practice on such copiers is to link the input flow rate of aqueous ammonia solution and the power of the vaporizing heater to the copier's printing speed. The ammonia entering at the input flow rate is then distributed over the heater, which extends over the width of the copier, to create the ammonia vapor requirement for the material being developed; the resulting weakened concentration of aqueous ammonia being overflowed to waste.

Disadvantages of this conventional method are that it:

meters the aqueous ammonia input rate, which is inherently inexact due to the very small changes in aqueous flows which needs to be sensed, and is further complicated by the variation in rate and concentration of the waste flow, has a limited reserve capacity for ammonia vapor which leads to vapor starvation when long lengths of material are being developed, requires a lengthy warm-up period between switching on the copier and the initial print, plus a significant pause between speed selection and printing of long lengths of material to allow the copier to settle to the new setting, consumes ammonia while the copier is idling, even though no material is being processed, thus contributing to an ammonia odor in the vicinity of the copier and excessive consumption of ammonia, requires space heaters to avoid re-condensation of the vaporized ammonia, which together with the speed regulated vaporizing heater results in an excessive total power consumption rate, discards to waste a solution still containing a fairly high percentage of ammonia which also contributes to an excessive consumption of ammonia, requires a lengthy shut-down period to scavenge the developer tank of ammonia vapor to avoid condensation.

Broadly, to enable amelioration of at least some of these disadvantages, one aspect of this invention utilizes a control of the pressure of the gaseous developing agent with which copy material is treated, in place of controlling the flow rate of a solution of it. The invention provides, in this aspect, apparatus for developing exposed copy material wherein a gaseous developing agent is passed from a reservoir through a gas governor which functions to reduce its pressure to a set lower value, and thence into a chamber with an apertured or porous surface past which the copy material to be developed travels. Preferably the developing agent is also passed through a valve means operative to admit the vapor to that chamber only when required.

SUMMARY OF THE INVENTION

When a developing agent is to be generated by evaporation from a solution of it, there is proved a vessel partitioned into a reservoir chamber and a low pressure chamber. A heater in the reservoir chamber and a sensor to sense the pressure is connected to the heater and arranged so that in use when the reservoir is partially filled with the solution, the solution is heated to, and maintained at, a temperature at which there is a predetermined pressure in the gas space above the solution. A gas governor is connected to an outlet from the gas space and arranged to reduce the pressure of developing agent passing through it to a set lower value. Valve means are connected downstreams of the gas governor to the low pressure chamber with the low pressure chamber having an array of exit apertures for the developing agent. The apparatus includes means to convey copy material past the array of apertures and in close proximity to cause the valve means to open when the presence of copy material is sensed.

The present developing apparatus also incorporates a vessel to contain a solution of a developing agent, having means for transferring solution between the said vessel and a portable container, comprising three ports to the said vessel, each with a respective valve to close it. At least a first one of the said ports opening into an upper part of the vessel, and at least a second one of said ports leading into a lower part of the vessel. A pump is provided to circulate the solution, with connecting means sealingly leading three pipes into the portable container. The first one of the pipes being connected to the first port and opening into the upper part of the container, the second one of the pipes being connected to the second port and the third of the pipes extending from the lower part of the container to the pump. A further pipe extends from the pump to the third port. Preferably a fourth port, also with a valve to close it, enables the upper part of the vessel to be opened to atmosphere.

Since the largest proportion of the ammonia odor emitted by a conventional diazo copier comes off the developed material with the remainder coming from the copier itself, the overall odor level is generally high, dictated by the printing rate, the quantity of developed material to be found in the print-room and also by the ventilation rate of the room. A conventional means of scavenging this odor is to apply the suction side of a fan to the copier, at a pont where the developed material is just prior to its exit, with the pressure side of the fan exhausting to atmosphere, however, the effectiveness of purging developed material merely by suction on the casing of a conventional copier with the resulting slight negative pressure is limited.

There have been disclosures of proposals to apply heat, notably radiant heat, to the developed material within an enclosed section of the copier from which the ammonia driven off by the heat is drawn out by suction. Such prior proposals as have controlled the heat applied to the developed material have varied the heat output in proportion to the copying speed. We have now found that this does not allow satisfactorily for variations in the extent of usage of the copier, and in the length of individual pieces of developed material.

This invention, however, controls the heat output of a heating means in dependence on the temperature achieved. Preferably the arrangement is such that the heating means delivers full output if the sensed temperature is below a predetermined value, and a progressively reduced output as the temperature rises above a predetermined value. The reduction with rising temperature might be to complete extinction, or might be to a minimum output level.

Preferably both the means for treating the copy material with gaseous developing agent, and the heating means, are housed within a single enclosing chamber, having restricted apertures to allow entry and exit of copy material, and provided with an extraction fan to draw off surplus developing agent, and maintain a subatmospheric pressure therein. The apparatus also suitably has an enclosing chamber within which the copy material is treated with developing agent, and a multistage fan arranged to extract the developing agent. The fan may exhaust into ducting leading out of the room containing the copier, but preferably it delivers the extracted air and developing agent into a vessel containing a developing agent neutralizing solution.

Broadly, in this aspect, the invention provides a vessel for neutralizing solution, an inlet for air and the developing agent to be neutralized, opening into a low part of the vessel, an outlet from an upper part of the vessel for air which has bubbled through the neutralizing solution, and baffles in the path of air passing upwardly through the vessel. Preferably the baffles comprise an immersed lower set to lengthen the path of air through the solution in the vessel, and an upper set, spaced from the lower set by more than the spacing between adjacent baffles in either set, to block the path of splashing solution, the baffles in the upper set including inclined surfaces to facilitate drainage of solution from them. The vessel may have an inlet pipe concentrically within a cylinder, baffles extending inwardly from the cylinder wall towards the pipe alternating with baffles extending outwardly from the pipe towards the cylinder.

BRIEF DESCRIPTION OF THE DRAWINGS

FIG. 2 is a view of the ammonia reservoir vessel and fittings thereto, with the vessel shown in section along line II—II of FIG. 1;

FIG. 5 is a diagrammatic cross-section showing the operative parts of the gas governor.

DETAILED DESCRIPTION OF A PREFERRED EMBODIMENT

Figure 1:
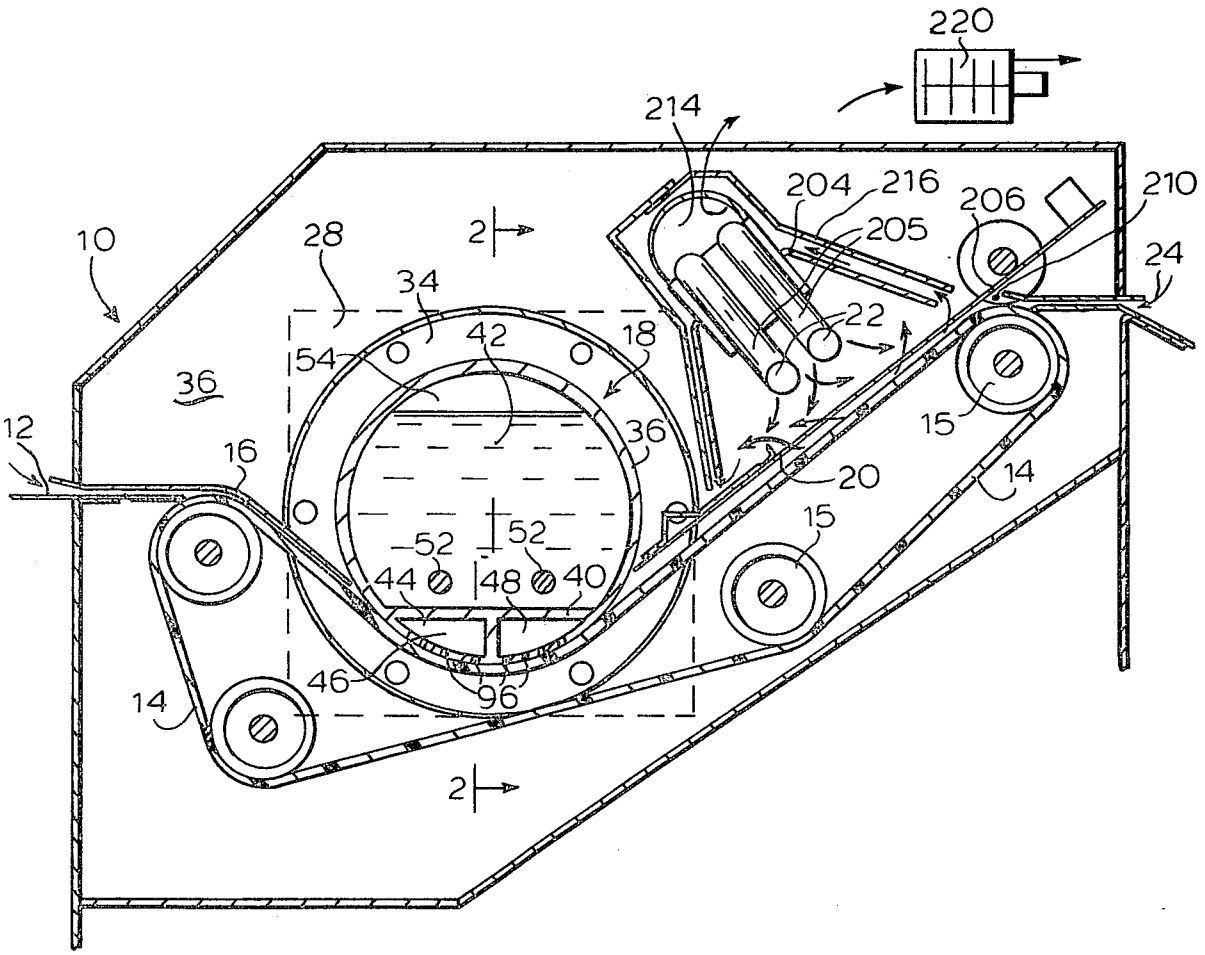
FIG. 1 is a section through the developing section of the copier, longitudinally of the paper path, with certain other parts of the copier also schematically indicated.

Referring first to FIG. 1 of the drawings, the diazo copier has a developing section contained within an enclosing casing 10. Copy material which has been exposed to form latent image thereon enters through the narrow slit 12 and an endless blanket 14 running over rollers 15 carries the copy material along a path through the developing section which first runs under a guide 16, then around the lower part of a cylindrical vessel 18 where the copy material is treated with ammonia vapor to develop the latent image thereon, under a guide 20 and then under radiant heaters 22 to drive off the surplus ammonia from the developed copy material after which it leaves the enclosing chamber 10 through a narrow exit slit 24.

AMMONIA SUPPLY

The vessel 18 comprises a cylindrical aluminum extrusion 26 closed by aluminum castings 28, 30 to which the cylindrical extrusion 26 is sealed by means of sealng gaskets 32 (FIG. 2). The cylindrical vessel 26 is fast with two annular collars 34 which in their turn are sealed to sidewalls 36 of the enclosing chamber 10 so that the ends of the vessel 18 lie outside this chamber 10.

Figure 3:
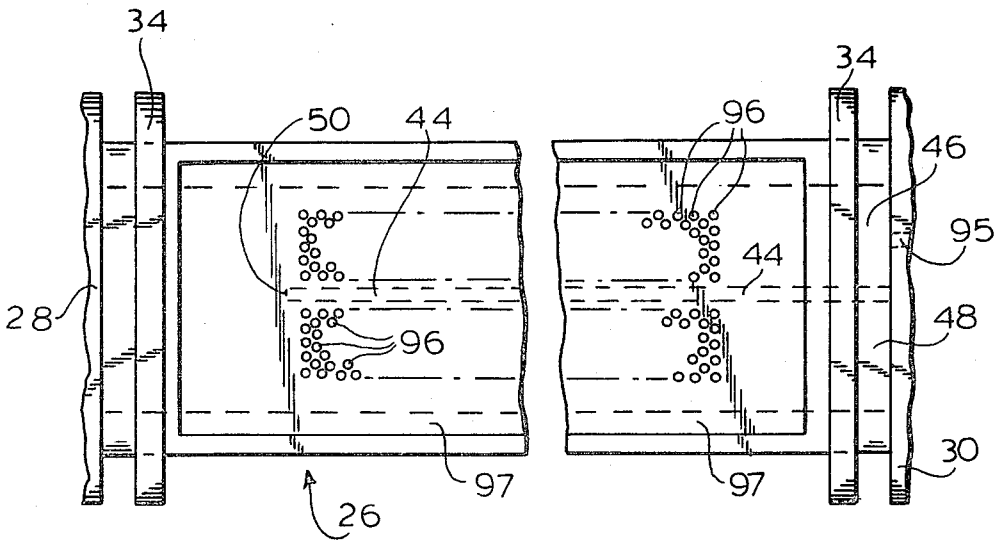
FIG. 3 is an underneath view of the reservoir vessel.

The extrusion 26 is partitioned by a horizontal internal web 40 into an upper chamber 42 which functions as a reservoir and a lower chamber divided by a vertical web 44 of the extrusion into two parts 46, 48 which are in communication with each other because an end portion of the web 44 is removed so that it terminates at point 50, which is spaced from the casting 28 (FIG. 3).

For operation the reservoir chamber 42 is partially filled with aqueous ammonia and this is heated by a sheathed electric heater 52 immersed in the ammonia solution. Ammonia vapor is evaporated from the solution and a reservoir of ammonia vapor is generated above it in the upper space 54. This space 54 is connected through bores 56, 58 to a pressure switch 60, mounted on top of the casting 28 and connected to control the heater 52. The pressure switch 60 is arranged to turn on the heater if the pressure in chamber 42 falls below a predetermined value—which is setting of the switch—and to turn the heater 52 off if the pressure rises above a predetermined value—which is also a setting of the switch and may be the same as the first predetermined value of somewhat above it. The heater 52 is supplied with electricity under the control of the switch 60, for the whole time that the copier is running, whether actually making copies or in a standby condition. Typically this would be throughout the working day. In this way the aqueous ammonia in the chamber 42 is kept heated to such a temperature as to maintain above it ammonia vapor at a pressure (determined by the switch 60) of 4 to 8 p.s.i. i.e. 112 to 224 inches water gauge).

The reservoir chamber 42 is initially charged with aqueous ammonia of the standard strength for diazo copiers, specific gravity 0.908. At this stage it will only be necessary to heat it to about 35–40° C. to produce the required pressure of ammonia vapor in the space 54. The time taken to heat up the ammonia solution constitutes the initial warm-up time of the copier and at this stage will be of the order of seconds. As the copier is used, and ammonia evaporated from the solution is consumed, the solution will become progressively weaker and it will be necessary to heat the ammonia to higher temperatures to generate the required pressure. This is achieved automatically because the heater 52 is controlled by the pressure switch 60. Ammonia generation can continue until the solution is rather weaker than the normal waste solution from diazo copiers. As the solution nears the end of its life it will be necessary to heat it to approximately 70° C.

In order to monitor the strength of the ammonia solution, a sensor 68 for its temperature is provided. This is connected to a dial gauge (not shown), and temperatures at which the ammonia solution should be changed are indicated by a red segment of the dial. The temperature is not critical, however, and when the pointer of the gauge reaches the red segment we have found it satisfactory to continue using the copier for the rest of the working day. It can then conveniently be left to cool overnight, and the ammonia solution changed when cold the following morning.

The space 54 also communicates with a safety relief valve 62 in which a resilient membrane 64 is positioned so as to be distended by the pressure within the space 54 towards a spike positioned to puncture the membrane (and hence relieve the pressure) if the pressure in the space 54 exceeds 20 p.s.i.

At the end 30, the space 54 is connected to a gas governor 70 which functions to reduce the pressure of the ammonia vapor to a much lower pressure—in this embodiment 4 to 11 inches water gauge has been found satisfactory for speeds of up to 30 feet per minute. A higher pressure might be desirable for faster speeds. The gas governor is essentially similar to gas governors used for controlling the supply of town gas or natural gas to domestic appliances. Indeed a commercial gas governor can be employed, provided any parts liable to be corroded by the ammonia are replaced with similar parts made from ammonia resistant material. FIG. 5 shows the construction within a gas governor: an inlet 72 delivers into a space 74 bounded by a flexible membrane 76 connected to a valve 78 to close the inlet. The pressure in the space 74 urges the diaphragm 76 against a compression spring 80 and when the pressure in the space 74 is sufficient to overcome the spring 80 the valve 78 closes preventing admission of further gas via the inlet 72 until the pressure in the space 74 falls. In this way the pressure in the space 74 is controlled and gas at the controlled pressure leaves via the outlet 82. The outlet pressure can be adjusted by moving a plunger 84, against which the spring 80 bears, towards or away from the diaphragm 76. In this embodiment provision is made for adjusting the pressure by turning an adjusting screw 86 which bears on top of the plunger 84 and is accessible through the top 88 of the gas governor 70.

Ammonia at the pressure determined by the gas governor is admitted to flexible tubing 92 which leads to a solenoid valve 94 which when open admits low pressure ammonia vapor through a passage 95 in the casting 30 into the chamber 46 in the lower part of the cylindrical vessel 18. Any moisture vapor condensing in the tube 92 runs down a branch tube 93 to a trap from which it can be removed. Since the chambers 42, 46, 48 are all part of the same vessel they are at the same temperature, thus inhibiting the condensation of moisture in spaces 46, 48. Ammonia in the spaces 46, 48 can diffuse out through a multiplicity of small holes 96 in the lower part of the vessel 18. In order that the ammonia should be distributed more evenly, a sheet of cartridge paper 97 overlies the holes 96 and is held in place by a perforated sheet of polytetrafluoroethylene over the sheet of paper and adhered along its edges to the vessel 18. The copy material to be developed by the ammonia diffusing out of the holes 96.

As indicated by FIG. 1, the path of the blanket 14 follows the curvature of the vessel 18 around an arc of its circumference which is slightly greater than the arc over which there are holes 96. The pressure exerted by the blanket 14 is spread evenly over the entire surface circling each of the holes 96, and there is good sealing between the vessel 18 and the blanket 14.

Delivering the ammonia vapor through the solenoid valve 94 makes it possible to start and stop the release of ammonia with some precision and thus reduce to a low level the amount of ammonia wasted by release other than when strictly required for copying. The valve is arranged to be normally closed and no ammonia at all is released when the copier is in a standby condition.

Copy material passing through the copier trips a microswitch connected to electronic control means which open the solenoid valve, thus releasing low pressure ammonia into the lower part of the vessel 18. The ammonia has to displace air from this part of the vessel as it enters, which could lead to uneven ammonia distribution across the width of the copier. This is obviated by the vertical web 44, by reason of which the spaces 46, 48 effectively constitute arms of a U-tube. The ammonia from the solenoid valve enters arm 46, flows along it, and enters the arm 48 around the end 50 of the web at the opposite side of the copier, with the result that any unevenesses in the distribution of ammonia down the length of the spaces 46, 48 compensate for each other.

In this embodiment the microswitch is positioned adjacent the copy path in the exposure section of the machine where the latent image is formed, so that opening of the valuve 94 and admission of ammonia to the spaces 46, 48 is initiated before the leading edge of the copy material reaches the developing section of the copier. The electronic control connected to the microswitch allows a delay between the trailing edge of a piece of copy material passing the microswitch and closing of the solenoid valve. The delay is sufficient for the training edge to have just passed the apertures 96 when the solenoid valve closes. However, since the spaces 46, 48 provide some reserve of ammonia vapor the valve 94 could be arranged to close before the trailing edge of the copy material reaches the apertures 96, the ammonia contained in the spaces 46, 48 then being used to develop the last part of the copy material.

With the arrangement described above the space 54 contains a reserve of ammonia in vapor form whether the copier is in operation or in a stand-by condition, and this reserve of vapor is readily available for developing material.

Consequently, when long lengths or runs of material are processed there is sufficient vapor available (without there being excessive amounts for short lengths of material) and vapor starvation, leading to copies with a faded appearance. Also there is no need for a substantial delay to let conditions in the machine settle after the speed of the copier is changed.

The setting of the gas governor can be adjusted by moving the plunger up or down, (which as mentioned can be accomplished by means of an adjusting screw 86). The setting can be adjusted if necessary to allow for changes in the characteristics of the copy material being used—notably changes in its reluctance i.e. greater or lesser ease of development by ammonia. We have found it unnecessary to change the governor setting for a range of different copying speeds, but this could be done if required. This might for instance be needed if the range of copying speeds was wide. A suitable arrangement for doing this would be to have a wedge 87 as shown in phantom in FIG. 5, connected to the speed control of the copier to be moved laterally across the plunger when the speed was changed means (not shown) also being provided for adjusting the vertical position of the wedge 87 to adjust the governor setting independently of the copying speed.

The copier has been described as using standard 0.908 S.G. ammonia solution. It would however, be entirely feasible to use ammonia of greater concentration and it would also be possible to convert the copier to use anhydrous ammonia. For the latter, the pressure switch 60 would be removed and a supply of anhydrous ammonia gas (reduced to a pressure approximately 4–8 p.s.i. by the control on the ammonia cylinder) led in through the bore 56 to the space 52. Since the ammonia used for diazotype development must be moist the chamber 42 would be partially filled with water and the heater 52 controlled by a thermostat to maintain the water at a suitable temperature to sufficiently humidify the ammonia as it passed through the space 54.

FILLING AND DRAINING

Figure 4:
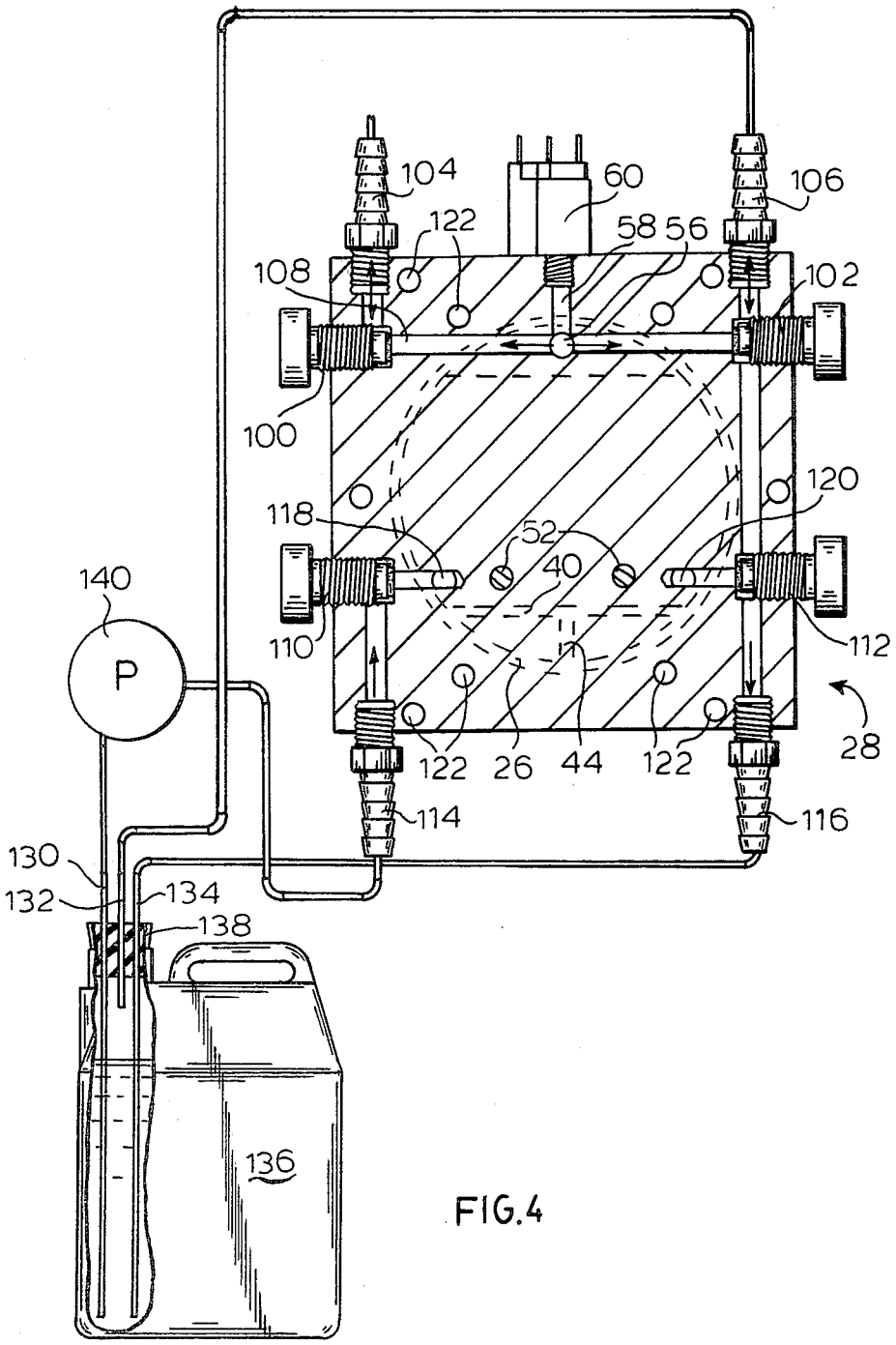
FIG. 4 shows one end of the reservoir vessel in section on line IV—IV of FIG. 2, schematically indicating connection to a pump and to a portable ammonia container.

An arrangement is provided to enable filling of the chamber 42 and draining of it without necessitating the lifting of an ammonia bottle to an inconvenient height or its being left open to the atmosphere for an extended period of time. The casting 28 is drilled and provided with valves and ports as shown by FIG. 4. Valves 100, 102 control communicating between respective ports 104, 106 and a bore 108 connecting with the bore 56 which gives access to the space 54 in the upper part of the chamber 42. Further valves 110, 112 allow communication between respective ports 114, 116 and bores 118, 120 communicating with the lower part of the chamber 42. (The apertures 122 are used for fixing).

A closure member is provided for sealingly leading three tubes 130, 132, 134 into a portable plastic container for aqueous ammonia solution. In this embodiment the closure member simply consists of a bored bung 138 but a more elaborate closure member to engage with the normal screw thread on the neck of the container 136 be used. The tubes 130, 132, 134 are connected by flexible plastic piping (shown only diagrammatically) to a pump 140 and to the ports 106, 116 while the pump 140 is also connected to the port 114. The valves 100, 102, 110, 112 can then be designated as VENT, BALANCE, FILL AND DRAIN valves respectively.

For filling the chamber 42 the bung 138 is fitted to a full container 136 of ammonia solution and the balance valve 102 and fill valve 110 opened after which the pump 140 is used to pump ammonia solution from the low part of the container 136 into the chamber 42 via the port 114 and bore 118 while air displaced from the chamber 42 passes out of the bore 56 and the port 106 back into the top part of the container 136 via the tube 132 so that ammonia fumes are not discharged into the working environment.

When the ammonia solution in the copier becomes spent it is allowed to cool which of course creates a subatmospheric pressure in the chamber 42. To relieve this the vent valve 100 is opened briefly and then closed. The bung 138 is fitted to an empty container 136 and the drain valve 112 and balance valve 102 opened, allowing a spent ammonia solution to drain via bore 120, port 116 and tube 134 into the container 136 while air passes through the tube 132, port 106 and bores 108, 56 into the upper part of the vessel 42.

The line from tube 132 to port 106 constitutes a balance line, and enables the system to be closed throughout almost the entirety of the filling and draining operations.

AMMONIA SCAVENGING

After passing the cylinder 18 the developed copy material is carried under radiant heat lamps 22 to heat it and drive out unreacted ammonia. The lamps are mounted within a reflective hood 204 in a staggered array which gives uniform heating across the width of the copier. They are supported, and supplied with electric power, by means of metal straps 205. Suitable lamps are Philips 1 Kw infrared heat lamps, sold under their number 13195X. Thin stainless steel wires 206 extend above the blanket 14 to ensure that copy material passing beneath the lamps cannot come into contact with them. Thin wires are employed since these are capable of conducting the heat they absorb out of the hot zone.

The inherent fast reaction of infrared heat lamps permits these heaters to be switched from OFF to ON, or from one power level to another without the need for any significant delay period in order to allow the heat setting selected to be reached. A continuously energized, or thermostatically controlled, low wattage heater could be fitted to maintain a minimum temperature adjacent to the heat lamps if this is desired to assist the fast reaction of the heat lamps.

The lamps 22 are controlled by an electronic control connected to a temperature sensor 210 positioned adjacent the paper path just downstream of the area irradiated by the lamps. A glass bead thermistor is employed as the sensor, because of its sensitivity.

The thermistor 210 is connected to an electronic control for the lamps 202, which is also connected to the aforementioned microswitch tripped by copy material passing through the exposure section of the copier. The control is arranged to turn the lamps 22 on to their full output, when the leading edge of a piece of copy material trips the microswitch. The lamps will thus be at their full output by the time the material comes beneath them. The control keeps the lamps at full output—irrespective of the copying speed—for as long as the temperature sensed by the thermistor 210 remains below 35° C. When it rises above this, the power supplied to the lamps is reduced linearly with increasing temperature, to zero at a sensed temperature of 42°–45° C.

We have found that this arrangement supplies sufficient heat to scavenge material of ammonia over a range of copying speeds, even though the heat output is not directly linked to copying speed, and prevents the temperature rising to excessive levels with long runs of copy material.

When the trailing edge of a piece of copy material passes the microswitch the electronic control cuts off the power to the lamps 22 after a sufficient delay for the trailing edge to pass beneath them. The length of this delay is varied by the electronic control in accordance with the copying speed of the machine. (A conceivable alternative would be to provide a second microswitch adjacent the copy path just after the heat lamps 22, the lamps 22 then being turned off when the trailing edge of the material passes this second microswitch).

Since breakage of the thermistor 210 could allow the temperature to rise indefinitely, a more rugged metal thermistor is also provided directly adjacent thereto and this is also connected to the electronic control so that if the thermistor 210 fails, the lamps 22 become controlled in dependence on the thermistor 212, which is less sensitive but provides sufficient control for safety.

The design of an electronic control having the required characteristics in within the ordinary skill of the electronics industry.

Ammonia driven out of the copy material is released into the enclosing chamber 10, as is any ammonia leaking from between the blanket 14 and the vessel 18. It is sucked out through an aperture 214 in the wall 36 of the casing 10, by means of a fan (to be described below) which maintains a slight subatmospheric pressure in the chamber 10. The air removed is replaced by air entering through the narrow slits 12, 24.

The aperture 214 is beneath a second hood 216 which overlies the hood 204 so that air being sucked out of the chamber 10 passes up the space between the two hoods and cools the reflective hood 204.

AMMONIA EXTRACTION AND DISPOSAL

Air and ammonia fumes are drawn out of the aperture 214 by means of a 4-stage fan 220. This has four fan blades in sequence on a single driven shaft and has its motor in a sealed enclosure to protect it from the ammonia fumes. A suitable fan is that sold by Air Control Insulations Ltd. under their designation 4MS8. The fan could discharge the air and ammonia fumes into conventional exhaust ducting if desired and use of a multi-stage fan will be desirable even under these circumstances in view of the need to remove the ammonia driven off the copy material by the heat lamps 22.

However, in this embodiment the multi-stage fan is employed to force the extracted air and ammonia fumes through a neutralizing vessel shown in FIG. 6 wherein the air ammonia fumes are driven several inches below the surface of a quantity of citric acid solution.

Figure 6:
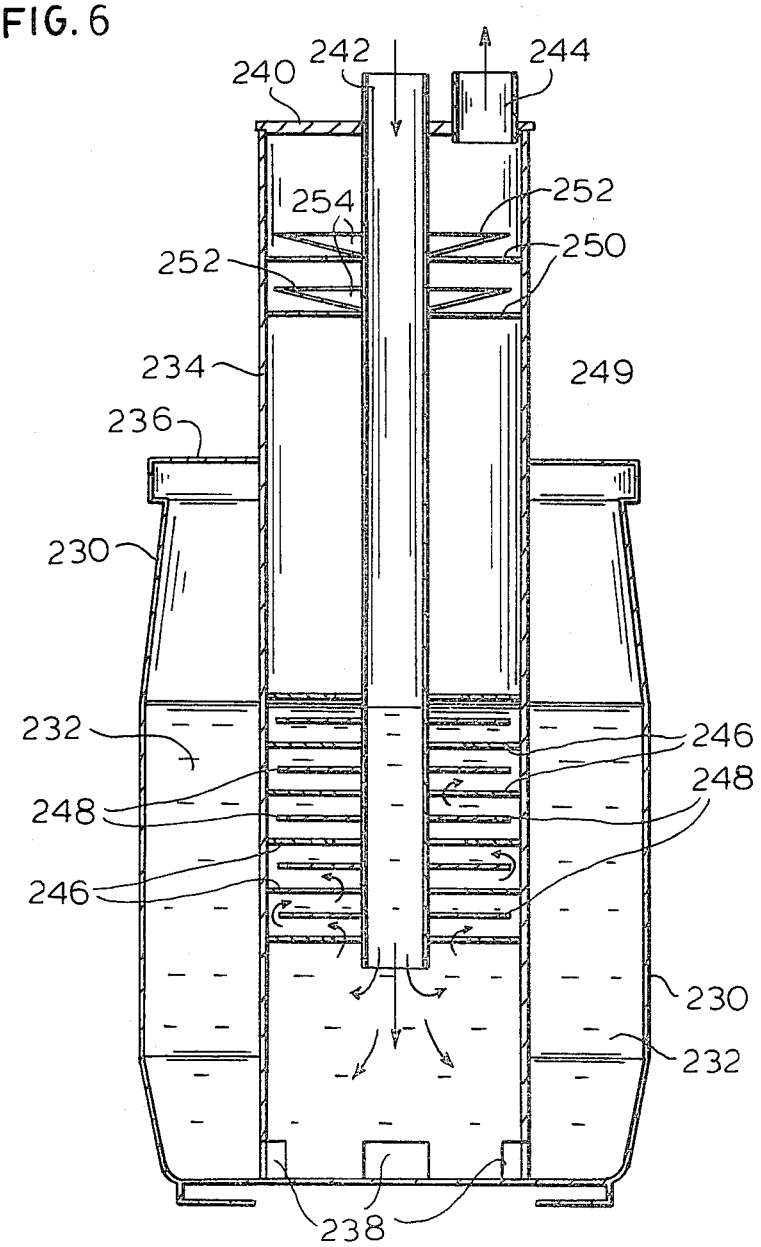
FIG. 6 is a cross-section of the vessel containing neutralizing acid.

Referring now to FIG. 6, the neutralizing vessel is formed by a wide mouthed plastic container 230 of sufficient size to be approximately two-thirds filled by aqueous citric acid solution 232. A cylinder 234 stands within the vessel 230 and is fast with a lid 236 which is normally clamped onto the vessel 230 but can be disconnected and removed together with the cylinder 234 for filling or emptying the vessel 230. Apertures 238 are provided at the base of the cylinder 234 to allow the solution 232 to flow into and out of the lower part of the cylinder. The cylinder 234 is closed by a lid 240 through which pass an inlet pipe 242 down which air and ammonia fumes withdrawn from the chamber 10 are driven by the multi-stage fan, and an outlet tube 244.

As shown the tube 242 extends to several inches below the surface of the citric acid solution 232 and the fan has sufficient power to drive the exhausted air laden with ammonia vapor down this tube to bubble out into the citric acid solution. It rises up within the space between tube 242 and cylinder 234. The ammonia vapor dissolves in the citric acid solution as ammonium citrate and in order to lengthen the flow path through the citric acid solution a series of baffles are provided. These comprise annular baffles 246 extending inwardly from the cylinder 234 towards, but stopping short of, the tube 242 alternately with baffles 248 extending outwardly from the tube 242 towards, but not so far as, the cylinder 234.

A certain amount of foaming is caused by the passage of air through the citric acid solution and this foam rises up into the space 249 which is provided to accommodate it and allow its break-up. At the top of the space 249 there are provided further baffles 250 252 which block any splashes and unlike the other baffles, which are planar, the parts of the baffles 252 which are in front and behind the plane of FIG. 6 are bent so as to be inclined downwardly as indicated at 254 to promote drainage of liquid splashes. Air which has bubbled up through the citric acid solution finally leaves the cylinder 234 through the tube 244 and is released to the room environment: we have found that this air typically has its ammonia concentration reduced to as low as 7 p.p.m. The various baffles not only lengthen the flow path through the citric acid solution 232 and block splashing but also serve to reduce noise from air bubbling into the citric acid solution.

A suitable quantity of citric acid in the solution 232 is 7 Kg for a charge of 10 liters of ammonia solution of 0.908 S.G. in the chamber 42 of the copier. The citric acid solution can be made by dissolving 7 Kg of citric acid in 14 liters of water, giving about 20 liters of solution. Such a solution has been found to remain effective for the life of the 10 liter charge of ammonia solution in the chamber 42 and when that ammonia solution is changed the strength of the citric acid solution can be restored by adding solid citric acid crystals to it. It is envisaged that the citric acid solution 232 would need complete replacement at less frequent intervals than the ammonia solution in the chamber 42, and indeed changing the solution 232 could be carried out as part of routine maintenance of the copier. A chemical indicator, changing color at a suitable pH, may be included in the citric acid solution.

I claim:

1. A developing apparatus for photocopy machines comprising, in combination, a developing chamber, means for transporting sensitized paper through the developing chamber, means for introducing developing medium into said developing chamber in controlled amounts, pressure activated control means for regulating the means for introducing developing medium into said developing chamber and heating and suction means to expunge developing medium from the sensitized paper subsequent to said paper exiting the developing chamber.

2. The apparatus of claim 1 wherein the heating and suction means consist of a radiant heating means and a suction fan.

* * * * *